US005518396A

United States Patent [19]

Muzzolini et al.

[11] Patent Number: 5,518,396

[45] Date of Patent: May 21, 1996

[54] SELF-POWERED FLAME MONITORING APPARATUS

[75] Inventors: Dario Muzzolini; Giancarlo Arrigoni, both of Udine, Italy

[73] Assignee: Zeltron S.p.A., Udine, Italy

[21] Appl. No.: 489,841

[22] Filed: Jun. 13, 1995

[30] Foreign Application Priority Data

Jun. 14, 1994 [IT] Italy ..... PN94A0039

[51] Int. Cl.[6] ..... F23N 5/10

[52] U.S. Cl. ..... 431/80; 331/66

[58] Field of Search ..... 431/80; 331/66

[56] References Cited

U.S. PATENT DOCUMENTS 4,565,519 1/1986 Carignan ..... 431/80

4,984,981 1/1991 Pottebaum ..... 431/80

*Primary Examiner*—Carroll B. Dority

*Attorney, Agent, or Firm*—Pearne, Gordon, McCoy & Granger

[57] ABSTRACT

An oscillator (3) drives a controlled switch (6) of a converter (2) using a periodic pulse signal that alternately determines long closing times ($T_{on}$) and short opening times ($T_{off}$). During the closing times, the converter stores energy generated by a thermocouple (23) in the presence of a flame. During opening times, the conductor supplies energy at a higher value to remaining circuitry of the monitoring apparatus. The converter comprises an LED (9) to indicate the presence of the flame to be monitored.

7 Claims, 3 Drawing Sheets

15mV
10mV
5mV
0
V

VD

I

T on
20mA
10V
VD

170mV
I(LED)

T off
20mA

SELF-POWERED FLAME MONITORING APPARATUS

BACKGROUND OF THE INVENTION

The present invention relates to a self-powered flame monitoring apparatus that can be used in appliances having a gas burner, such as boilers, water heaters, and the like. In particular, this flame monitoring apparatus is suitable for use in portable or movable appliances, such as absorption-type refrigerators, that are adapted to be able to operate for prolonged periods in the absence of a regular power supply from power mains.

In portable appliances of the above cited type, the flame monitoring apparatus must have a prolonged operating autonomy, so that it should not be battery-operated. As a consequence, the flame monitoring apparatus usually comprises a thermocouple-based arrangement which, in response to the presence of the flame, energizes an electromagnetic gas-control valve. A display instrument is adapted to indicate the presence or absence of the flame. Since the electric power of such a thermocouple is very low, the display instrument must be of a very sensitive, highly responsive type. Such displays are undesirably delicate, fragile and expensive, i.e., unsuitable for use in a portable appliance.

SUMMARY OF THE INVENTION

It is an object of the present invention to provide a self-powered type of flame monitoring apparatus which is particularly simple, robust and reliable.

According to the present invention such an aim is reached in a self-powered flame monitoring apparatus having the characteristics recited in the appended claims.

BRIEF DESCRIPTION OF THE DRAWINGS

The characteristics and the advantages of the present invention will be more apparent from the description given below by way of non-limiting example with reference to the accompanying drawings, in which.

DETAILED DESCRIPTION OF THE PREFERRED EMBODIMENTS

Figure 1:
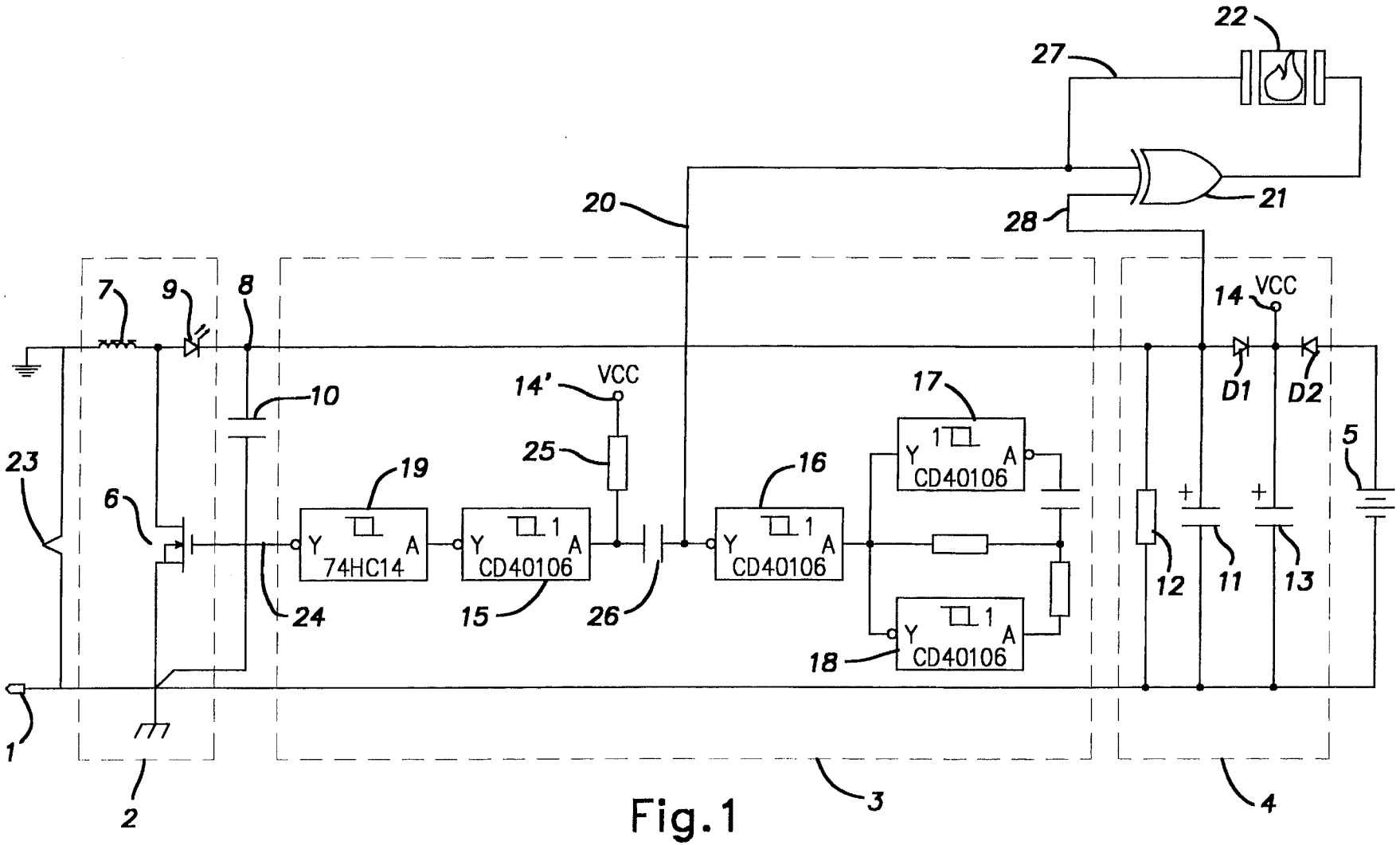
FIG. 1 is a wiring schematic of a first embodiment of a self-powered flame monitoring apparatus according to the present invention.

A self-powered flame monitoring apparatus according to the invention is installed in an appliance, preferably a portable appliance. The appliance includes a gas burner supplied through an electromagnetic valve 1, shown in FIG. 1. In a known manner, the flame monitoring apparatus includes a thermocouple 23 adapted to generate a low, direct current voltage (approx. 15 mV) in response to a flame being present at the gas burner. Such a voltage generated by the thermocouple keeps the electromagnetic valve 1 open until the burner flame goes out.

According to the present invention, the thermocouple 23 supplies power to a DC-DC boost converter 2. The converter, as explained below, has the function of boosting the voltage supplied by the thermocouple for energizing remaining circuitry of the flame monitoring apparatus, which therefore is self-powered.

The remaining circuitry mainly comprises a drive oscillator stage 3 (Low Power Oscillator & Drivers) and a power-supply filtering and control stage 4 (Power Supply Control & Filter). There is further provided at least one low-voltage (for instance 3 V), long-life battery 5, which is connected to a decoupling diode D2.

The converter 2 includes a controlled switch formed by a MOSFET transistor 6, preferably a 50-V power mosfet logic level type. The transistor 6 may, for instance, be an SGS Thompson STP55NO5L characterized by low cost, low drain-source resistance (20 mΩ), and low driving voltage (5 V).

The drain electrode of the transistor 6 is connected to an inductor 7, and the series circuit of the transistor 6 and the inductor 7 is connected in parallel across the thermocouple 23. The inductor may, for instance, have a rating of 380 μH and is preferably formed by a coil of oversized copper wire (having a diameter of 1 mm, for a maximum peak current of 200 mA), so as to obtain a resistance of just a few tens of a mΩ.

The drain of the transistor 6 is also connected to an output 8 of the converter 2 through a photoemitting diode 9 (LED) which is provided to act as a rectifier and is arranged in such a position as to be visible by a user.

Capacitors 10 and 11, as well as a discharge resistor 12 are connected in parallel between the output 8 of the converter and ground. Additionally, in the power supply 4, a further capacitor 13 is connected between the ground and an output terminal 14. The diode D2 and another decoupling diode D1 are connected in an OR arrangement. The diode D1 is connected in series with the capacitor 13 in relation to the output 8 of the converter 2. The capacitors 10, 11, 13 are provided to perform the function of filtering the voltage delivered by the converter 2.

The output 14 of the power, supply 4 is connected to a corresponding power-supply input 14' of the oscillator stage 3. The oscillator stage 3 includes mainly an array of trigger circuits (Schmitt Triggers) 15–18 connected as shown in FIG. 1 together with a driver circuit 19. An output 24 of the driver circuit 19 is adapted to drive the switch 6 of the converter 2 with a periodic pulse-type waveform,,as described in more detail below. For instance, the circuits 15–18 may be respective integrated circuits RCA CD40106, and the driver circuit 19 may be formed by an integrated circuit RCA 74HC14.

The oscillator stage 3 preferably also includes a further output 20 which is connected to a first input 27 of a logic gate 21 of an XOR type. A second input 28 of the gate 21 is connected to the output 8 of the converter 2. A display means 22 of a liquid-crystal type, which is particularly suitable to be driven by a square wave, is connected between an output and the first input 27 of the gate 21. ARC derivative network 25, 26 is provided between the power-supply input 14', the output 20 and the integrated circuit 15.

As will become more apparent in the following description, the oscillator stage 3 is always in operation, even when there is no flame. When there is no flame, the oscillator stage 3 receives its power supply from the starting battery 5 via the diode D2. Under such conditions, the oscillator-stage 3 draws in a negligibly low current (approx. 12 μA) from the battery 5, which therefore is capable of preserving operating autonomy under conditions that are substantially the same as normal "self-discharging" conditions.

When the thermocouple 23 detects the presence of a flame, a low voltage (15 mV) is generated across the thermocouple. This voltage would normally not be able to energize the various circuits of the self-powered flame monitoring apparatus. According to the present invention, however, an effective transfer of energy to the load from such a low-power supply source as the thermocouple 23 is carried out with different voltage levels. The voltage levels are obtained by substantially differentiating conduction times from $T_{on}$ from cutoff times $T_{off}$ of the converter 2. For instance, the conduction or closing times $T_{on}$ (FIGS. 2, 3 and 4) are approximately 5 msec, while the cutoff or opening times $T_{off}$ (FIGS. 5 and 6) are approximately 4 μsec. In other words, for an efficient transfer of energy said times $T_{on}$ and $T_{off}$ are related to each other in a manner that is inversely proportional to the ratio existing between the voltage V generated by the thermocouple 23 and the output voltage VD across the controlled switch 6. In mathematical terms, such a condition is expressed by following formula: $T_{on} \times V = T_{off} \times VD$.

To this end, the oscillator stage 3 includes an oscillator made of the integrated circuits 17 and 18. The oscillator is configured so as to generate a symmetrical square wave having an on time $T_{on}$ of about 5 msec. Such a square wave, which is not shown for reasons of simplicity, is transferred to the output 20 of the stage 3 via a decoupling buffer formed by the integrated circuit 16.

The RC network 25, 26 senses the negative going edges of the square wave and is configured so as to supply the integrated circuit 15 with corresponding negative pulses having a duration $T_{off}$ of about 4 μsec. The output of the circuit 15 (comprising corresponding positive pulses) is still further amplified and inverted by the circuit 19, which drives the gates electrode of the switch 6 with a periodic pulse-type waveform, as described previously. As a result, the gate voltage of the switch 6 will be high during the times $T_{on}$ and low during the times $T_{off}$.

Figures 2, 3, 4, 5, 6:
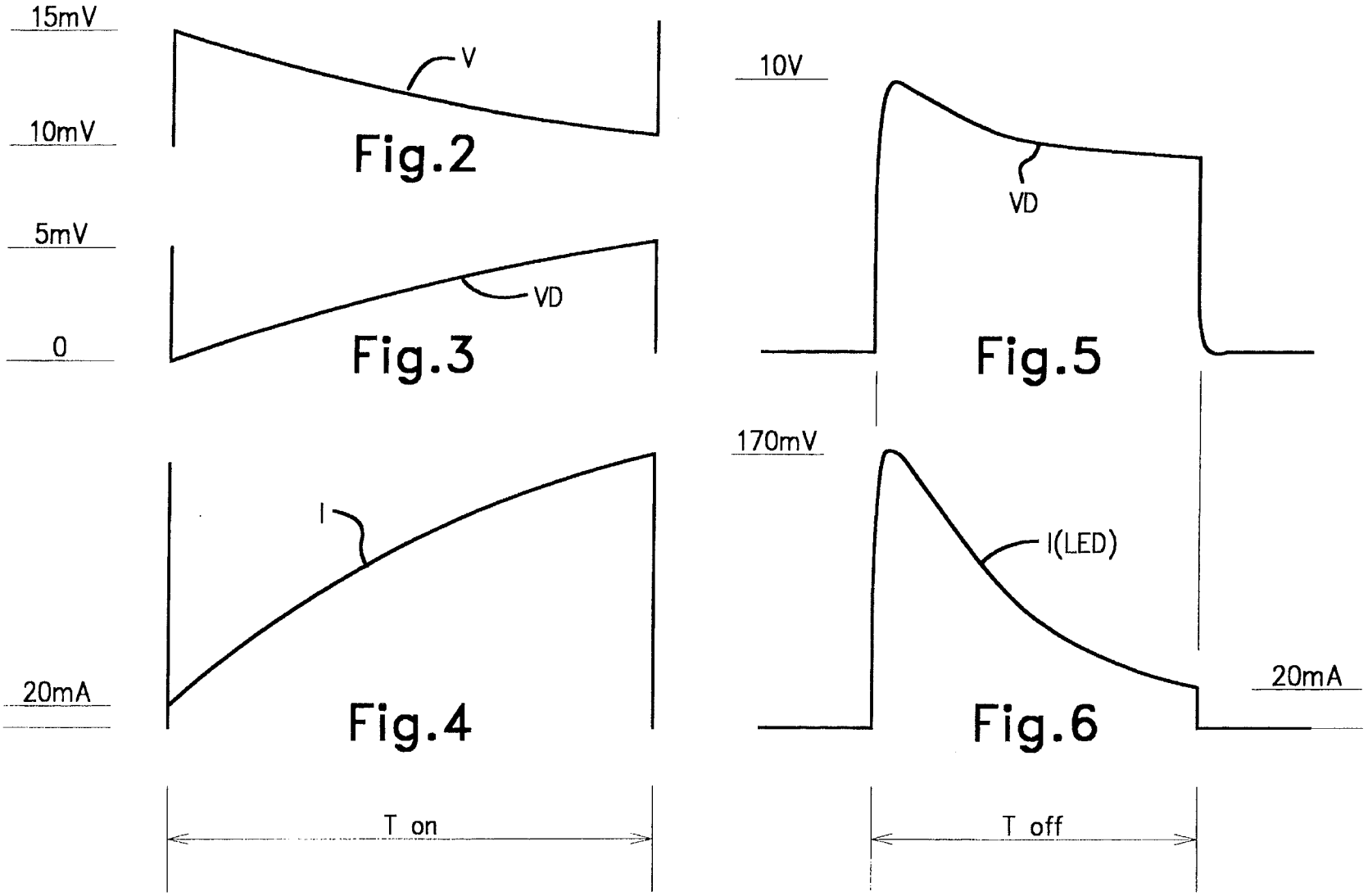
FIGS. 2 through 6 are schematic views of respective electric signals in the arrangement shown in FIG. 1.

In practical operation, therefore, the switch 6 is closed during each relatively long (5 msec) time $T_{on}$, thereby enabling the current delivered by the thermocouple 23 to circulate in the inductor 7, in which a corresponding amount of energy is stored in the form of a magnetic field. It has been verified experimentally (with a low-intensity flame being detected by the thermocouple) that, during the time $T_{on}$, the current I through the inductor 7 increases from approximately 20 mA to approximately 170 mA, as shown in FIG. 4. The voltage V generated by the thermocouple 23 decreases from approximately 15 mV to approximately 10 mV, as shown in FIG. 2. At the same time, the drop of the voltage VD across the controlled switch 6 increases from 0 mV to approximately 5 mV, as shown in FIG. 3. As a result, the average voltage that is effectively applied across the inductor 7 is approximately 10 mV.

At the end Of each time $T_{on}$, the switch 6 opens for a relatively short (4 μsec) time To. The voltage VD that is present at the terminal of the inductor 7 opposite to ground increases as shown in FIG. 5 until it reaches such a value (10 V peak) as to enable the inductor to convey the previously stored energy to the capacitors 10 and 11. Such a transfer occurs with a flow of current through the photoemitting diode 9, which therefore illuminates. The current I(LED) circulating through the diode 9 at the beginning of the time $T_{off}$ is of course equal to the current that is reached in the inductor 7 at the end of the time $T_{on}$. In the described example, during the time $T_{off}$ such a current I(LED) decreases from a peak value of approximately 170 mA to approximately 20 mA, as shown in FIG. 6.

Therefore, during each period of the afore cited periodic waveform, the current I(LED) flows through the diode 9 for a short time $T_{off}$ only. During the remaining time $T_{on}$ said diode 9 performs the function of preventing the capacitors 10, 11 from discharging through the closed switch 6.

The resulting pulsating-type illumination of the photoemitting diode 9 is sufficient to allow the user, due to the known phenomenon of persistence on the retina of the human eye, to perceive a continuous illumination of the same diode. Such an illumination of the diode will of course indicate the presence of the flame being monitored.

When the thermocouple 23 cools down in the absence of the flame being monitored, the converter 2 no longer delivers energy and the capacitors 10, 11 discharge through the resistor 12.

It should be noticed that the pair of diodes D1 and D2 in an OR arrangement enable the converter 2 and the battery 5 to decouple from each other, so that the oscillator stage 3 can be energized (at different times, as previously described) from either one of the power supply sources. In the absence of a flame, in particular, the circuitry of the monitoring apparatus is supplied from the battery 5 with a voltage (3 V) that is just sufficient to drive the switch 6, which does not become fully saturated. When the thermocouple 23 detects the presence of a flame, the converter 2 delivers a voltage of more than 6 V, which allows for driving of the switch 6.

Under condition of intense daylight or artificial lighting, the illumination of the photoemitting diode 9 may be poorly visible. Presence of the flame being monitored is therefore indicated by the display means 22, which, as previously described, is connected to the input 27 that is driven by the square wave present at the output 20 of the oscillator 3.

The input 28 checks whether an adequate voltage value is possibly present across the capacitor 11. When such a voltage is detected as being present, the input 28 enables the gate 21 to issue an output signal that is in opposition of phase with respect to the one present at said first input 27. Therefore, only when a voltage is present across the capacitor 11 (ie. in the presence of a flame) said display means 22 is energized by two square-wave signals which are similar to each other, but in opposition of the phase with respect to each other. It is common knowledge that this represents the optimum condition for driving a liquid-crystal display. It has been verified experimentally that the power available for the LED indicator 9 ranges from 0.5 to 1.0 mW.

The simplicity, reliability and robustness of the self-powered flame monitoring apparatus according to the present invention are inherently apparent. The selection of a time $T_{on}$ of approximately 5 msec represents an optimum compromise among various factors such as the required rating (and therefore the cost) of the inductor 7, the need to avoid wasting energy by too frequently charging and discharging the gate capacitance (3000 pF) of the switch 6, the possibility of operating with times $T_{off}$ that are suitable in view of the use of relatively low-cost component parts, as well as the additional energy saving effect to be reached through infrequent switching of the logic CMOS an HCMOS circuits used.

It will of course be appreciated that the afore described flame monitoring apparatus can undergo various modifications as may be considered to be adequate, without departing from the scope of the present invention.

Figure 7:
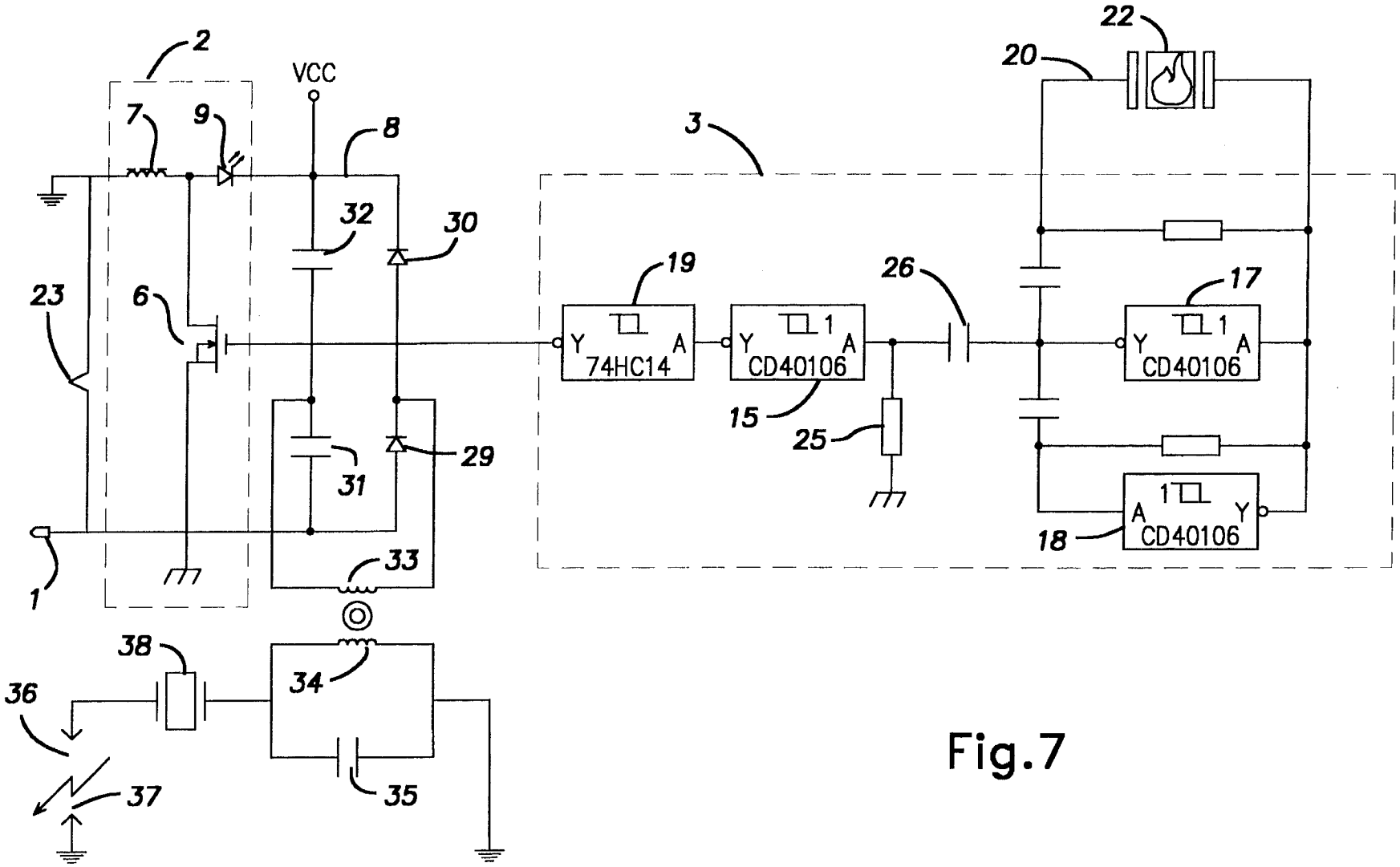
FIG. 7 is a wiring schematic of a second embodiment of the self-powered flame monitoring apparatus according to the present invention.

In the variant shown in FIG. 7, for instance, the starting battery 5 can be advantageously eliminated, thereby additionally enhancing the reliability of the whole flame monitoring apparatus. Also, other component parts can be eliminated from the variant shown in FIG. 7, such as for instance the power supply stage 4, the capacitor 10 and the gate 21. In this particular embodiment, the main component parts are the same as those used in the embodiment illustrated in FIG. 1, and the steady-state operation of the apparatus is substantially similar to the previously described operation. On the other hand, the display means 22 is driven directly (preferably through an RC decoupling network) by the square wave generated by the oscillator comprising the integrated circuits 17 and 18.

Furthermore, the output of a peak-to-peak rectifier formed by a pair of diodes 29, 30 and a pair of capacitors 31, 32 is connected between the output 8 of the converter 2 and the ground. The input of the rectifier 29–32 is connected across the secondary winding 33 of a transformer, the primary winding 34 of which forms a resonant circuit with a capacitor 35. The primary winding 34 is connected in series in a traditional piezoelectric discharge circuit for ignition of the flame being monitored. In a known manner, the ignition circuit is a closed loop comprising discharge electrodes 36, 37, as well a piezoelectric crystal 38 that is actuatable by means of a push-button or similar device, which is not shown in the drawing for simplicity. The primary winding 34 is provided on the "cold" side of the crystal 38, which is normally connected to a metal frame of the appliance.

In practical operation, the crystal 38 is actuated a first time to generate, between the electrodes 36, 37, an electrical discharge that ignites the flame to be monitored. The flame heats up the thermocouple 23 which within a few seconds, is able to regularly supply power and fully energize the flame monitoring apparatus.

At this point, it is sufficient to actuate the crystal 38 at least a second time. The resulting discharge current will flow through the primary winding 34 of the transformer, so that a corresponding voltage induced across the secondary winding 33 drives the rectifier 29-32, which in turn supplies the flame monitoring apparatus with the required start-up power.

The discharge current produced by the piezoelectric crystal 38 is known to usually have an irregular, substantially alternating and damped waveform, so that the use of a peak-to-peak rectifier 39-32 (i.e., a full-wave rectifier) enables the oscillations of both polarities of the discharge current to be utilized. Furthermore, the fact that the primary winding 34 of the transformer is tuned actually means that the efficiency of the whole system is optimized, thereby promoting transfer to the rectifier 29-32 of harmonic components of the discharge current which are the most significant source of energy. Thus, part of the energy (albeit very small) developed by the crystal 38 is transferred to the flame monitoring apparatus to enable it to start up and reach regular, steady-state operating conditions as described above.

What is claimed is:

1. A self-powered flame monitoring apparatus comprising thermocouple means adapted to generate a voltage in response to the presence of a flame, characterized in that the apparatus further comprises converter means (2) provided with a controlled switch (6); and oscillator means (3) adapted to drive said controlled switch (6) with a periodic pulse signal that alternately determines relatively long closing times ($T_{on}$) of the switch during which said converter means (2) are adapted to store energy produced by the thermocouple means (23) and relatively short opening times ($T_{off}$) of the switch during which said converter means supply the stored energy with a higher voltage value to other circuitry (3, 4) of the flame monitoring apparatus.

2. A self-powered flame monitoring apparatus according to claim 1, characterized in that the converter means (2) is adapted to supply energy to said other circuitry (3, 4) through a photoemitting diode (9) adapted to indicate the presence of said flame.

3. A self-powered flame monitoring apparatus according to claim 1, characterized in that the converter means (2) comprises inductor means (7) adapted for storing said energy during said closing times ($T_{on}$) in the form of a magnetic field.

4. A self-powered flame monitoring apparatus according to claim 1, further comprising indicator means and characterized in that the oscillator means (3) is adapted for generating a square-wave signal at an output (20) of the oscillator means that drives the indicator means (22) so as to signal the presence of said flame only when there is an adequate level of voltage in a control means (4) associated with the apparatus.

5. A self-powered flame monitoring apparatus according to any of the preceding claims, characterized in that the apparatus further comprises at least one start-up battery (5) adapted to supply power to the flame monitoring apparatus, through decoupling means (D2), only in the absence of said flame.

6. A self-powered flame monitoring apparatus according to claim 1, wherein the flame is adapted for being ignited by means of a piezoelectric-discharge ignition circuit, characterized in that a primary winding (34) of a transformer is connected in series with the ignition circuit (36, 37, 38) and a secondary winding (33) of the transformer drives an input of a full wave rectifier (29-32), the rectifier being adapted to supply the flame monitoring apparatus with start-up power required to reach regular power-supply conditions when the ignition circuit is operated.

7. A self-powered flame monitoring apparatus according to claim 6, characterized in that the primary winding (34) of the transformer is a part of a resonant circuit (34, 35).

* * * * *